US005621802A

United States Patent [19]

Harjani et al.

[11] Patent Number: 5,621,802

[45] Date of Patent: Apr. 15, 1997

[54] APPARATUS FOR ELIMINATING ACOUSTIC OSCILLATION IN A HEARING AID BY USING PHASE EQUALIZATION

[75] Inventors: Ramesh Harjani; Rongtai Wang, both of Minneapolis, Minn.

[73] Assignee: Regents of the University of Minnesota, Minneapolis, Minn.

[21] Appl. No.: 403,564

[22] Filed: Mar. 19, 1995

Related U.S. Application Data

[63] Continuation of Ser. No. 54,041, Apr. 27, 1993, abandoned.

[51] Int. Cl.[6] ..... H04R 25/00

[52] U.S. Cl. ..... 381/68.2; 381/68

[58] Field of Search ..... 381/68, 68.2, 68.4, 381/83, 71, 72, 93

[56] References Cited

U.S. PATENT DOCUMENTS

| | | | |
|---|---|---|---|
| 4,088,835 | 5/1978 | Thurmond et al. | 381/83 |
| 4,783,818 | 11/1988 | Graupe et al. | 381/71 |
| 4,845,757 | 7/1989 | Wagner | 381/68 |
| 5,016,280 | 5/1991 | Engebretson et al. | 381/68.2 |
| 5,185,803 | 2/1993 | Moyski et al. | 381/92 |
| 5,259,033 | 11/1993 | Groodings et al. | 381/68.2 |

*Primary Examiner*—Sinh Tran
*Attorney, Agent, or Firm*—Jay H. Maioli

[57] ABSTRACT

In a hearing aid, undesirable oscillations that are caused by acoustic feedback occur when the gain of the hearing aid amplifier is increased. These oscillations in the hearing aid system response are substantially suppressed by providing phase equalization that equalizes the phase of the microphone, amplifier, receiver and feedback path involved in the hearing aid. The phase equalization can be provided directly in the signal path at the output of the amplifier or by a separate inner loop feedback around the amplifier. The phase equalization can be provided by one or more first or second order filters that operate as an all-pass filter to provide a time delay but do not affect the magnitude of the signal in the audio frequency range.

4 Claims, 11 Drawing Sheets

APPARATUS FOR ELIMINATING ACOUSTIC OSCILLATION IN A HEARING AID BY USING PHASE EQUALIZATION

This is a continuation of application Ser. No. 08/054,041 filed Apr. 27, 1993 now abandoned

BACKGROUND OF THE INVENTION

1. Field of the Invention

This invention relates generally to apparatus for improving a hearing aid by eliminating oscillations and, more particularly, to apparatus for eliminating such acoustic oscillations by using phase equalization in the signal path.

2. Description of the Background

The typical hearing aid employs a microphone, an amplifier, and a receiver or output transducer located within the ear of the hearing aid wearer. Most modern hearing aids are of the in-the-ear (ITE) type, in which the hearing aid device is located entirely within the wearer's ear. There is another type that is even smaller that is located entirely within the ear canal of the wearer. In all such in-the-ear hearing aids, the audio signals are received near the entrance of the ear canal by the microphone and then amplified and transmitted via a receiver, which performs the electrical-to-acoustical conversion, as sound waves into the ear canal. The amplifier can also be designed to shape the spectral content of the audio signal as required to compensate for the extent of hearing loss of the wearer. In such hearing aids that fit entirely within the ear, it is the practice to provide a vent or passage way through the hearing aid to prevent the wearer from having the feeling of total occlusion that would be brought on by a solid hearing aid filling the ear canal.

A typical hearing aid such as described above is shown in FIG. 1 in which the hearing aid 10 is arranged within the ear canal 12 of the wearer so that audio signals can be received by a microphone 14, amplified in an amplifier 16, and fed to the receiver unit 18. The receiver unit then converts the electrical signals to acoustic signals that impinge on the ear drum 20. The vent is shown at 22, and it is seen that the inner portion of the ear canal 12 is in acoustic communication with the exterior of the hearing aid 10 and, thus, provides a feedback path between the receiver 18 and the microphone 14. In addition, because of the requirement for realistic tolerances in the dimensions of the body of the hearing aid 10, there will be some acoustic leakage between the hearing aid 10 and the ear canal 12, as represented at 24 and 26 in FIG. 1. Thus, an acoustic feedback path exists not only through the vent 22, but, also through the leakage areas 24 and 26 around the hearing aid 10.

Hearing aid research and modern solid-state fabrication techniques have permitted great improvements in the miniaturization of hearing aids, as well as permitting improvement in the overall sophistication of the hearing aid circuitry. In addition, by using such solid-state circuitry, the overall power consumption of a hearing aid has been lessened. Nevertheless, the fundamental problem that severely limits the maximum useable gain that can be provided by the amplifier still remains and that problem is based upon the above-described acoustic feedback. Such acoustic feedback places limits on the maximum usable gain and creates the extremely annoying "howl", which is very irritating to the wearer. Furthermore, the acoustic feedback oscillation alters the overall system response so much that the response at all other frequencies is also significantly degraded.

In analyzing this acoustic oscillation problem, it has been proposed to examine the hearing aid as a control system and FIG. 2 shows a signal flow graph for a typical hearing aid such as shown in FIG. 1. The blocks $T_M$, $T_{HA}$, and $T_R$ shown at 40, 42, 44, respectively, represent the transfer functions for the microphone 14, the amplifier 16, and the receiver 18, respectively. The block $T_F$ shown at 46 represents the transfer function of the acoustic feedback path 22, 24, and 26. Accordingly, in the schematic of FIG. 2 it is understood that the sound input and adder 48 whose output is fed to the input of the microphone transfer function 40, as well as the feedback path transfer function 46 and the output at the receiver transfer function 44, are all actually acoustic paths, whereas electrical signals are represented by the paths between the microphone transfer function 40, the amplifier transfer function 42, and the receiver transfer function 44.

The transfer function of the overall hearing aid including the acoustic feedback as shown in the system of FIG. 2 is given by:

$$T_{system} = \frac{T_M T_{HA} T_F}{1 - T_M T_{HA} T_R T_F} \quad (1)$$

By defining the open loop transfer function as:

$$T_{open} = T_M T_{HA} T_R T_F \quad (2)$$

it is possible to see that when the magnitude of the open loop transfer function is equal to unity and the phase is an integer multiple of 2 $\pi$, then the system transfer function is undefined and the hearing aid becomes unstable. That is, oscillation will occur.

It has been proposed to reduce the adverse effects of this acoustic feedback by altering either the magnitude or the phase relationships of the feedback-loop of the hearing aid. Phase altering approaches that have been proposed include a frequency shift where the input frequency spectrum of the signal entering the microphone is shifted by a few Hz prior to the amplified signal being fed to the receiver. This approach has been successfully practiced in public address systems for a number of years, however, it has not been successful in hearing aids because of the large percentage variation of the feedback path. On the other hand, the phase information can be altered by providing a time-varying delay in the signal path. This approach can provide a maximum of only 1–2 dB of extra gain and suffers from the further drawback that frequently an audible warbling sound is produced.

In practicing a gain altering technique, the primary purpose is to reduce the gain of the system at the frequency where the oscillations are most likely to occur. Typically, this is accomplished by providing a narrow band notch filter or a comb filter having a number of narrow band notch filters at the frequencies of oscillation. The problem with this approach is that only around 3 to 5 dB of additional usable gain is provided, which is not sufficient for high-gain hearing aids.

Another approach to overcoming this oscillation problem is to provide feedback cancellation in an attempt to cancel the entire effect of the acoustic feedback. Such an approach is represented in FIG. 3, in which an additional feedback path is provided that is intended to be 180° out of phase with the problematic acoustic feedback path. This feedback cancellation is represented in FIG. 3 at block 60 that takes the output of the amplifier block 42 and subtracts it from the output of the microphone block 40 by means of a signal summing block 62. Thus, the intent is to provide a transfer function in block 60 that produces a feedback path equal to, but 180° out of phase with, the acoustic feedback path, as represented by transfer function 46. Although this system does provide some relief from the undesired oscillations other problems are present, such as during normal use the acoustic feedback path changes quite dramatically and if the internal feedback 60 does not adapt to such changes, then the overall hearing aid system is likely to become unstable in any event. This instability is primarily due to the effects of the internal feedback path transfer function 60 itself.

Another problem with the feedback transfer function cancellation system shown in FIG. 3 is because the cancellation is occurring in the complex domain, that is, each transfer function has a real and imaginary part. This means that the precision necessary for the cancellation process for both the real part and imaginary part between $T_C$ and $T_M$, $T_R$, $T_F$ must be extremely accurate. Otherwise, a slight disturbances will result in oscillations. Thus, it would appear that this approach requires an adaptive mechanism to identify variations in the feedback transfer function and then to make the necessary changes to the feedback transfer function cancellation element 60. These adaptive algorithms are quite complex and would require a relatively large amount of signal processing power, which makes it impossible to place such a signal processor in an in-the-ear hearing aid.

Upon a slight increase in gain the system becomes quite unstable and peaks appear at the resonant frequencies when the gain is increased only slightly. It is these peaks and instability that are to be eliminated by the present invention.

OBJECTS AND SUMMARY OF THE INVENTION

Accordingly, it is an object of the present invention to provide an apparatus for eliminating acoustic oscillation in a hearing aid by using feedback cancellation involving phase equalization.

It is another object of the present invention to equalize the feedback phase by providing an additional feedback loop employing all pass filters that provide the appropriate delay to equalize the feedback.

According to an aspect of the present invention, by providing phase cancellation the hearing aid system is inherently more immune to both gain and phase variations. The present invention is capable of providing 180° of phase margin and is completely immune to gain variations, provided that the poles and zeros of the open loop transfer function lie in the left-half plane. This is possible only if the open loop transfer function of the hearing aid does not contain any right-half plane zeros, however, typically such right-half plane zeros are present in realizable hearing aids today. Thus, complete phase cancellation is not entirely possible. Nevertheless, by providing maximum phase cancellation where the phase delay of the original open loop is cancelled in the primary audio frequency region to the largest extent possible, the present invention provides a stable system that can permit increases in gain without acoustic feedback oscillations.

The above and other objects, features, and advantages of the present invention will become apparent from the following detailed description of illustrative embodiments thereof to be read in conjunction with the accompanying drawings, in which like reference numerals represent the same or similar elements.

DETAILED DESCRIPTION OF PREFERRED EMBODIMENTS

Figure 1:
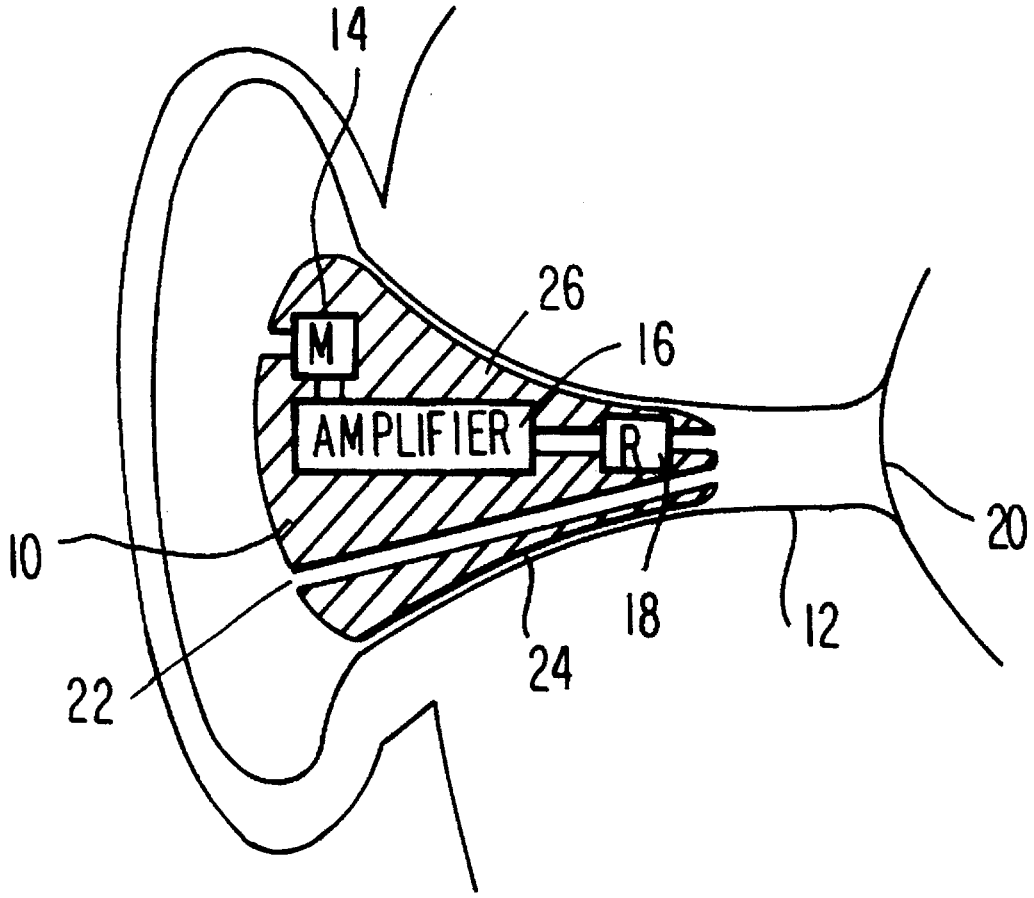
FIG. 1 is a pictorial representation in cross-section of an in-the-ear hearing aid known in the prior art.
Figure 2:
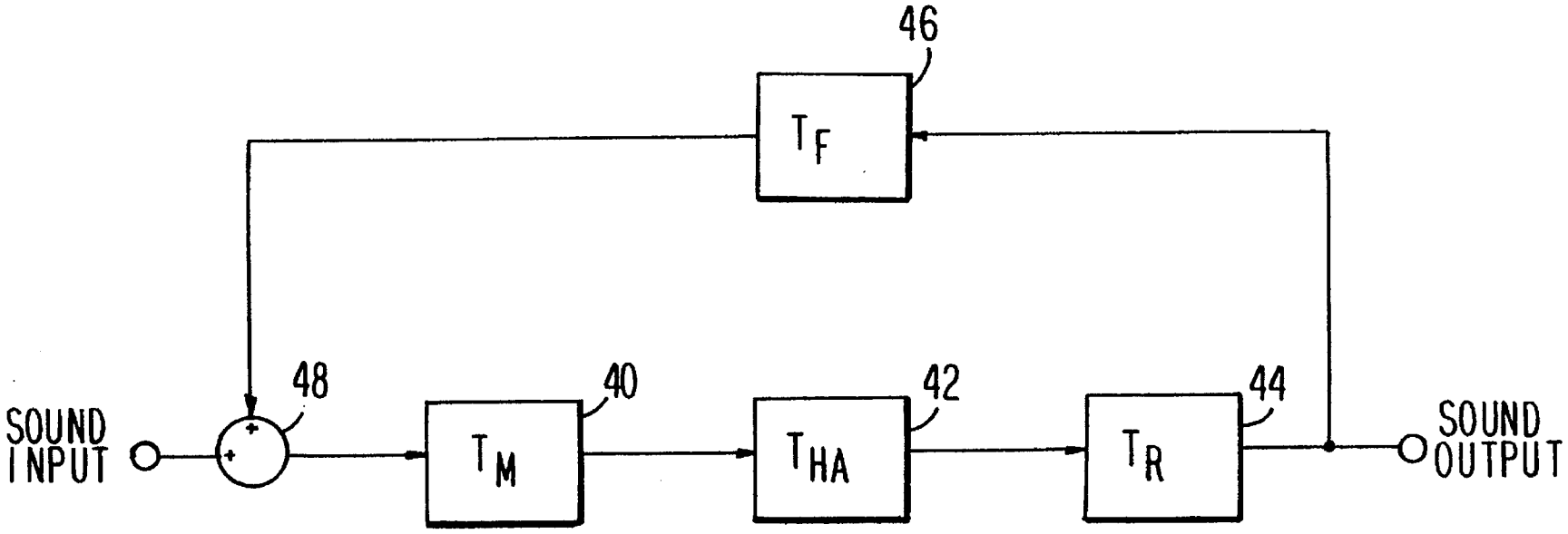
FIG. 2 is a signal flow graph of a control system model of the hearing aid of FIG. 1.
Figure 3:
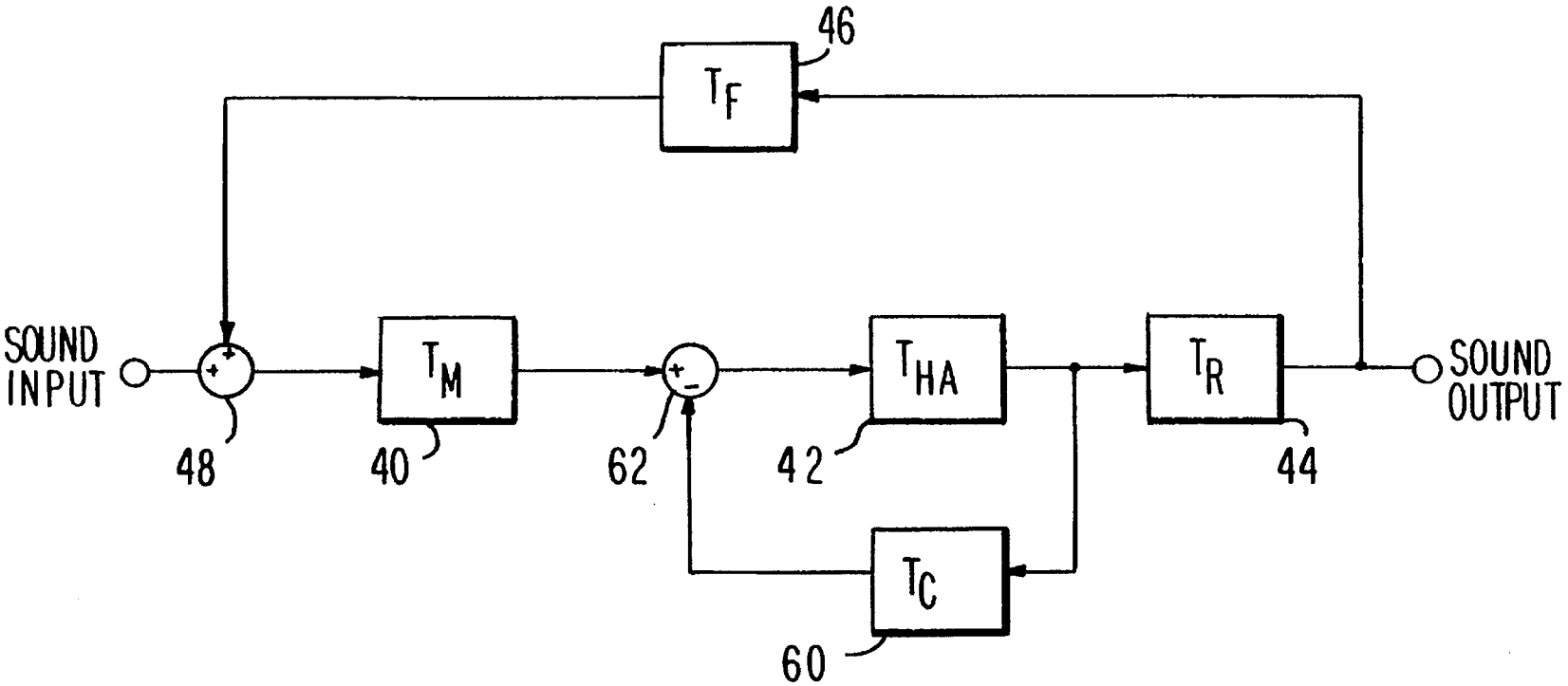
FIG. 3 (PRIOR ART)
FIG. 3 is a signal flow graph of the control system model of FIG. 2 including a feedback transfer function cancellation element as previously proposed.
Figure 4:
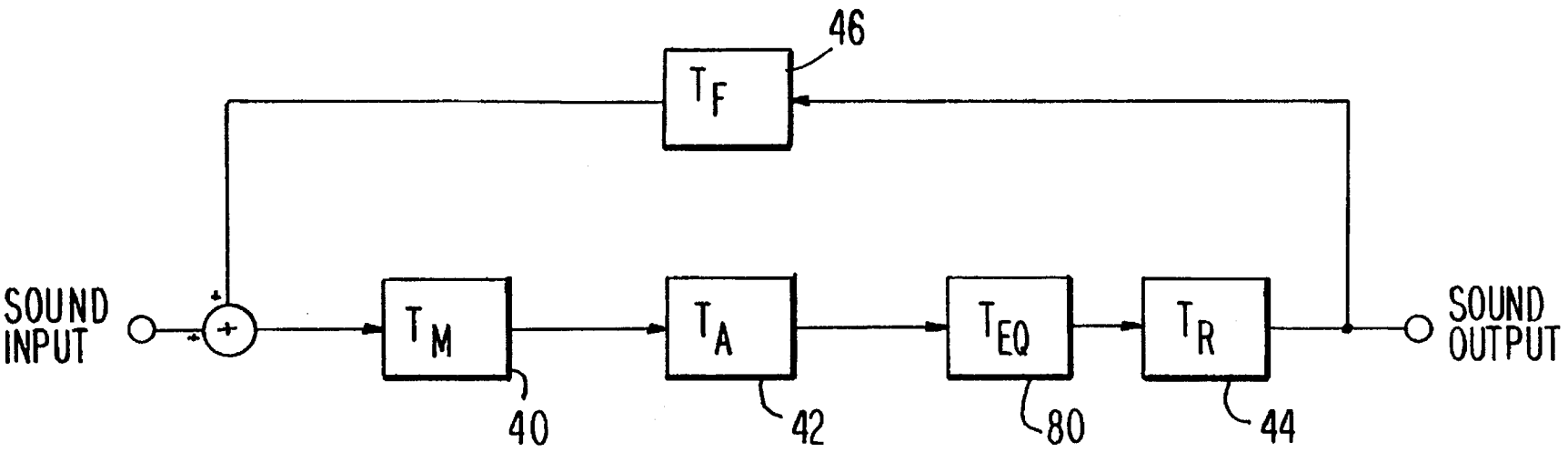
FIG. 4 is a signal flow graph of a control system model of a hearing aid including a phase equalization element according to an embodiment of the present invention.

The open loop transfer function of the system of FIG. 2, representing an ordinary hearing aid system, can be written as follows using complex variables.

$$T_{open} = A(s-z_1)\ldots(s-z_m)\left[\frac{(S+Z_{m+1})\ldots(s+Z_n)}{(s+P_1)\ldots(s+P_p)}\right] \quad (3)$$

where A is a constant, m is the number of right-half plane zeros, n-m is the number of left-half plane zeros, and p is the number of left-half poles. According to the present invention, the open loop phase delay is to be cancelled to as great an extent as possible. Thus, the maximum phase cancellation, under the constraint of system stability, can be reached by implementing a phase equalization block $T_{EQ}$ 80 as shown in FIG. 4 between the amplifier 42 and the receiver 44. The transfer function of the equalization block $T_{EQ}$ is equal to the inverse of the fractional portion of equation (3) above. That is:

$$T_{EQ} = \left[\frac{(s+P_1)\ldots(s+P_p)}{(s+Z_{m+1})\ldots(s+Z_n)}\right] \quad (4)$$

Thus, the phase equalization block 80 can be understood as a filter that has a transfer function such that the inverse of that transfer function is equal to all of the minimum phase factors from the microphone 40, the amplifier 42, the receiver 44 and the acoustic feedback path 46 in the system of FIG. 4. The phase equalization block $T_{EQ}$ then cancels the phase delay in the primary audio frequency range. In the following, the term phase delay refers to the minimum phase delay for all blocks concerned. The advantage of inserting TEe as transfer function block 80 into this loop is that the phase is maximally cancelled and the zero-phase frequencies become zero and infinity. Thus, no zero-phase point appears in the primary audio frequency region. One problem, however, is that the magnitude of the open loop including block $T_{EQ}$ increases rapidly with frequency increases. Additionally, it is generally desirable to reduce the gain at lower frequencies to increase intelligibility of the signal produced to the hearing aid wearer. The present invention deals with that problem by determining that there are some zeros in equation (3) located at the origin. In addition, there are a number of poles in the transfer function of the receiver transfer function 44 that lie beyond 10 KHz. This is known from measurement and because the impedance of most receivers increases rapidly with increased frequencies. Furthermore, such poles do not contribute an appreciable amount of phase delay in the primary audio frequency band. Thus, the phase delay provided by the phase equalization block 80 can be chosen as the input of the partial original open loop transfer function shown in equation (3), in which only the left-hand plane poles and zeros located in the primary frequency region of interest are included. Thus, the maximum phase equalization block 80 is then constructed as an all-pass filter that may consist of a series arrangement of first order and second order filters shown in detail in FIG. 10.

Figure 5A:
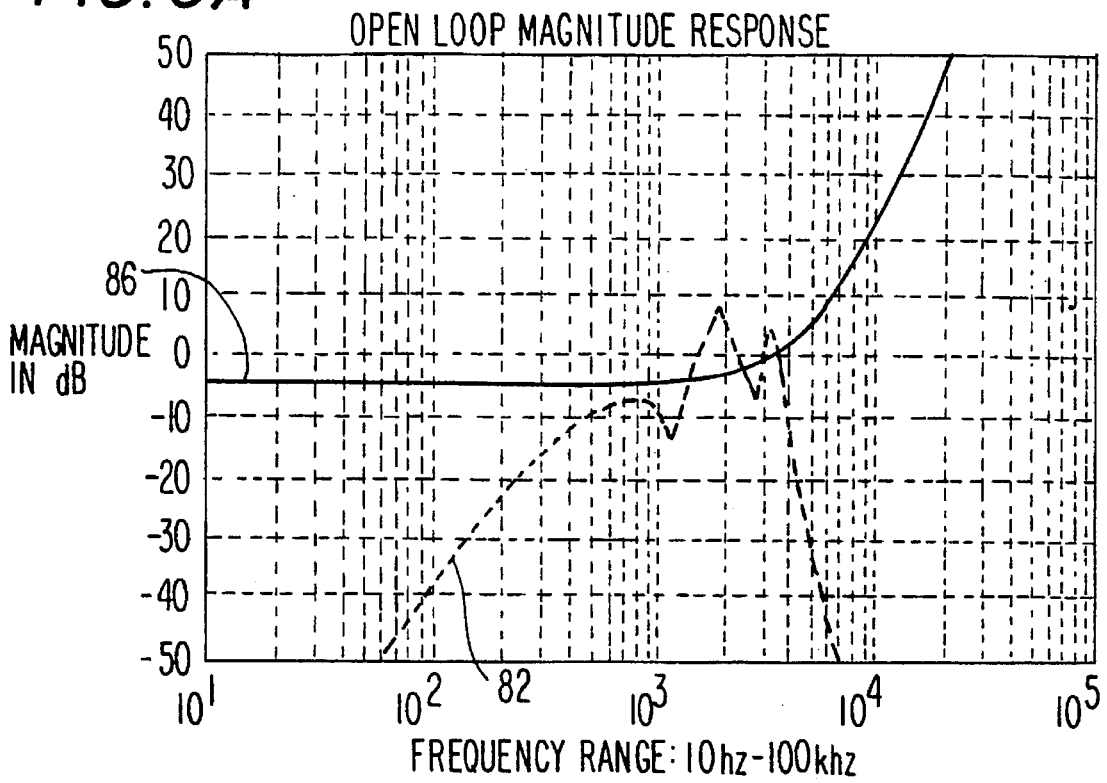
FIGS. 5A and 5B are plots of magnitude versus frequency and phase versus frequency, respectively, of the system transfer function for the system of FIG. 4.
Figure 5B:
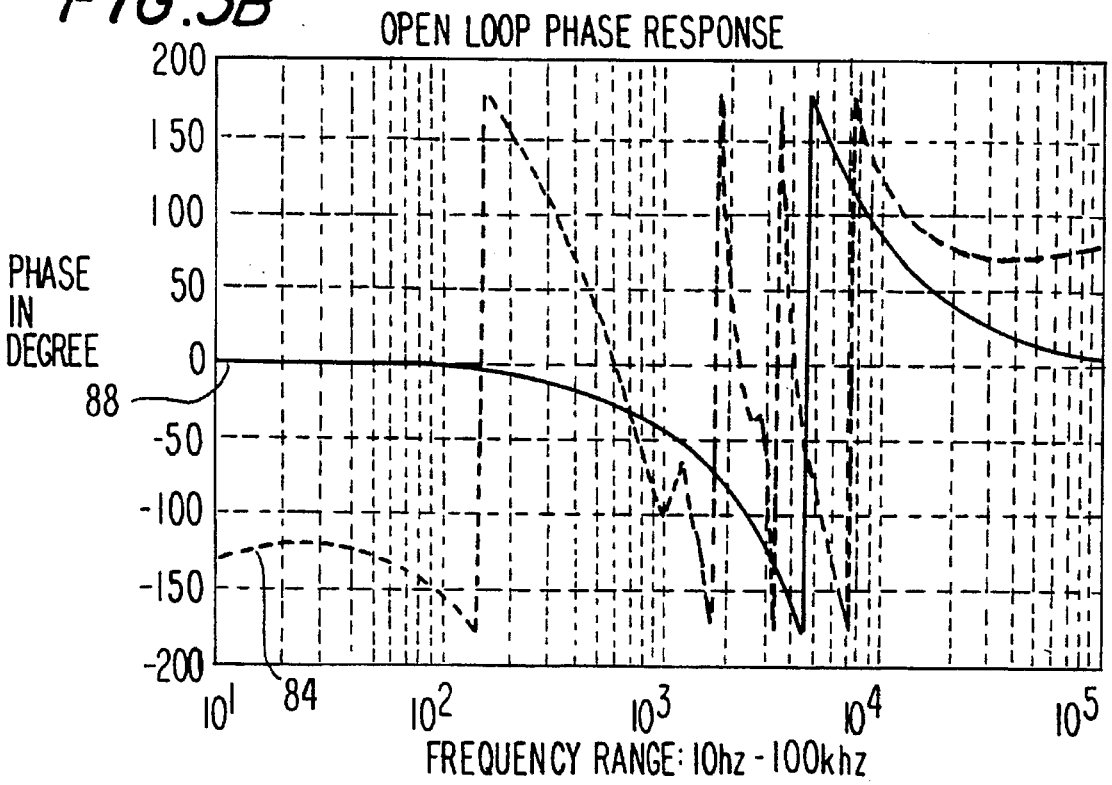
Figure 6:
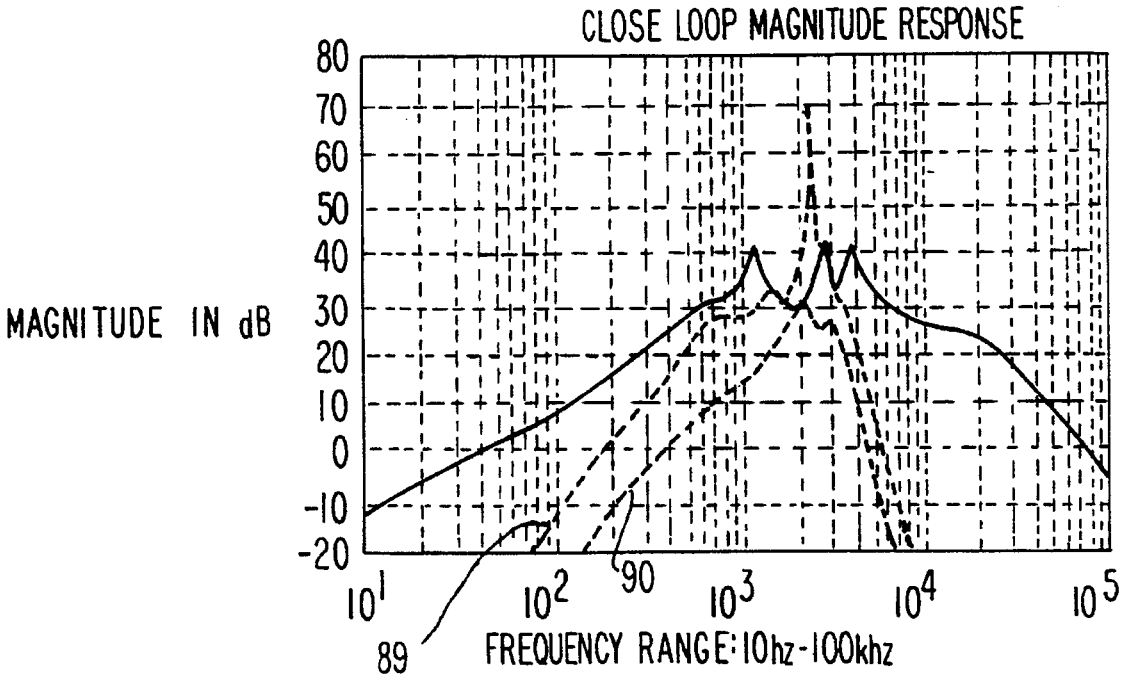
FIG. 6 is a plot of the close loop frequency response of the system of FIG. 4.

The response of the system shown in FIG. 4 in which acoustic feedback cancellation is provided by the maximum phase equalization block 80 is shown in FIGS. 5A–5B and 6.

In FIGS. 5A and 5B the response curves of the open-loop of the prior art, as represented by the system of FIG. 2, are shown compared with the open-loop of the system of FIG. 4 with the equalization block ($T_{EQ}$) 80 inserted between the amplifier block 42 and the receiver block 44. More specifically, the prior art response is shown by dashed lines 82 and 84 in FIGS. 5A and 5B, respectively, whereas the open-loop response of the inventive system of FIG. 4 is shown by solid lines 86 and 88, respectively. From 5B it is seen that the phase delay of the open-loop system of FIG. 4 with equalization block 80 inserted is much smaller that the prior art system. In the original open-loop phase response curve, as shown in FIG. 5B, there are three zero-phase frequencies at 0.6 kHz, 2.2 kHz, and 4.2 kHz, however, the magnitude of the open-loop transfer function exceeds unity at 2.2 kHz. As a result, oscillation occurs and this is shown in FIG. 6. in FIG. 6, dashed line 89 shows the closed-loop magnitude response of the original system, where the peak located at 2.2 kHz represents acoustic oscillations. In normal use of a hearing aid the transfer function of the acoustic feedback path is fixed, or varies unpredictably, so that the only way to avoid acoustic oscillation is to reduce the gain of the forward path. This means that practical usable gain is limited by the onset of acoustic oscillations. Thus, if the forward gain is reduced sufficiently no oscillations will occur, as represented by the dotted curve 90 in FIG. 6

Figure 7:
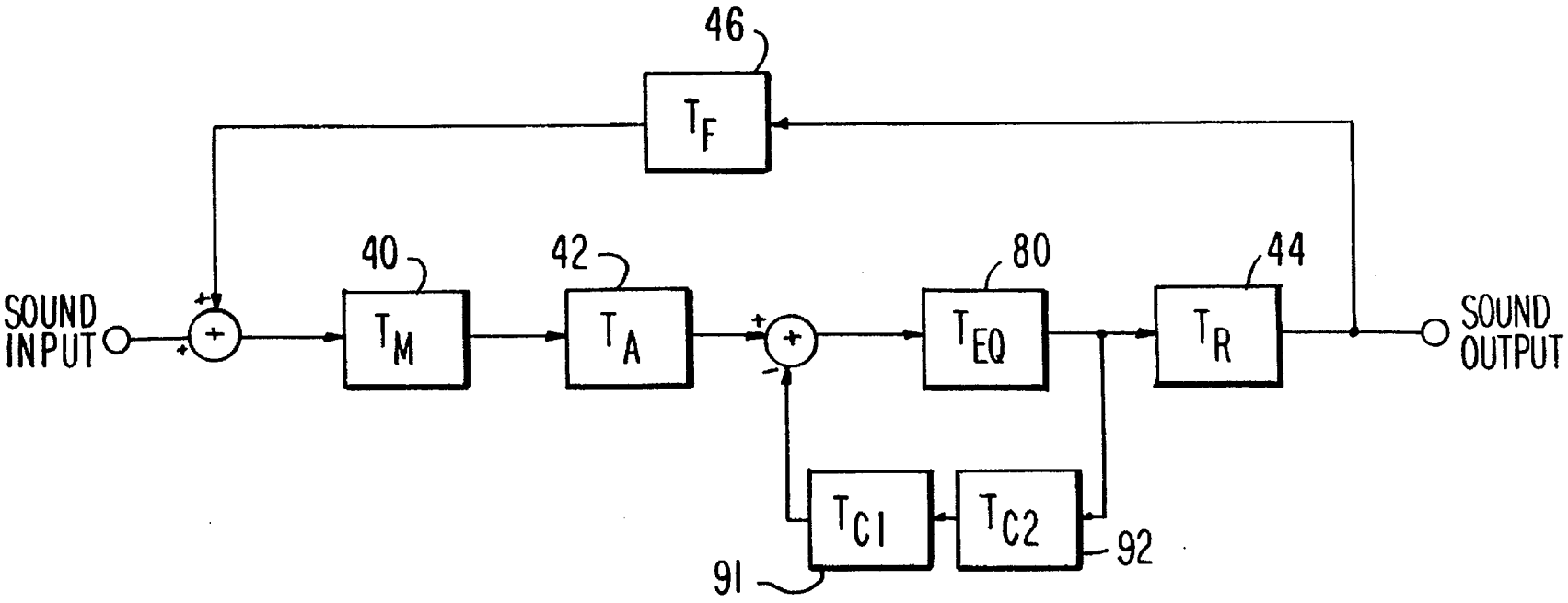
FIG. 7 is a signal flow graph of the control system model of a hearing aid according to another embodiment of the present invention.

According to another embodiment of the present invention even further magnitude reduction in the high frequency region can be obtained by implementing a negative feedback loop in addition to the maximum phase cancellation block 80 shown in FIG. 4. FIG. 7 shows the negative feedback loop employing cancellation blocks 91, 92 having transfer functions $T_{C1}$, $T_{C2}$, respectively. By selecting the transfer function $T_{C2}$ of cancellation block $T_0$ 92 to be equal to $1/T_{EQ}$, then the transfer function of this inner loop can be simplified as:

$$T_{inner}=T_{EQ}/(1+T_{C1}) \tag{5}$$

Thus, in order to maintain the stability of the system and suppress any acoustic oscillations, the transfer function $T_{C1}$ for the equalization block 91 is chosen to be a polynomial in the complex variable s of order m, which is the number of right-half plane zeros. The coefficients of that polynomial are chosen so that the transfer function of the resulting inner-loop $T_{EQ}/(1+T_{C1})$ will have only left-half plane poles and the zero phase crossing points introduced by the additional phase delay of $1/(1+T_{C1})$ lie outside the primary audio frequency region.

Both the embodiment of FIG. 4 and the embodiment of FIG. 7 are particularly suited for low-power analog applications.

Figure 8:
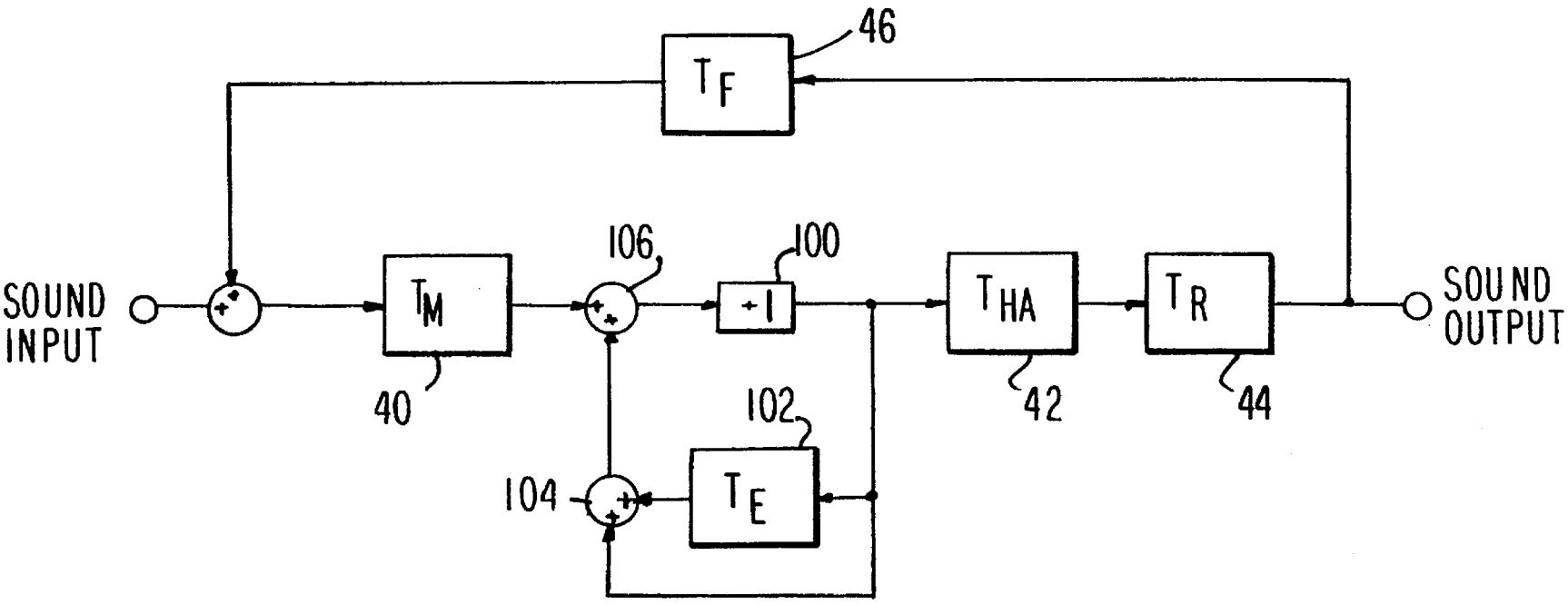
FIG. 8 is a signal flow graph of a control system model of a hearing aid including a feedback equalization system according to yet another embodiment of the present invention.

Turning to FIG. 8, another embodiment of the present invention is provided in which the overall system block diagram uses feedback phase equalization, which is particularly suited for digital implementation. The feedback phase equalization elements are arranged at the input to the amplifier transfer function block 42 and include a unity gain amplifier 100 and a phase equalization transfer function $T_E$ shown at block 102. The output of the unity gain amplifier 100 is then fed to the phase equalization block 102 and also to a signal summer 104 which receives the output of the equalization block 102. The summed signal is then added to the output of the microphone block 40 in a signal summer 106, with the resultant signal being passed through the unity gain amplifier 100 to the input of the amplifier block 42.

The equalization transfer function $T_E$ of element 102 is chosen to satisfy the relation:

$$T_E=e^{J}(\phi M+\phi HA+\phi R+\phi F) \tag{6}$$

where:

$$\phi_m=<T_M$$

$$\phi_{HA}=<T_{HA}$$

$$\phi_R=<T_R$$

$$\phi_F=<T_F \tag{7}$$

The angle notation < represents the difference in phase between the input signal and the output signal.

Then, the system transfer function becomes $$T_{system}=\left[\frac{T_{FW}\times e^{-j\phi F}}{1+T_{FW}+T_F}\right] \tag{8}$$

Where $T_{FW}$ is the forward transfer function of equation (2). Although negative feedback is well-known for use in reducing the gain at the output of a system, generally no attempt is made to completely cancel the effects of phase in such system. Typically, negative feedback is used to reduce the effects of some positive feedback that is inherent in the system. On the other hand, the present invention, as shown in the embodiment of FIG. 8, provides phase equalization in the feedback loop, that is, $T_E$=exp (j $\phi_E$), where $\phi_E$(f) iS the phase of the equalization of the block 102 and is a function of frequency. Although at some frequencies the phase equalization block 102 will provide positive feedback, for the most part the negative feedback is provided so that the contribution of this loop is then a frequency dependent phase shift. By employing the concept of frequency dependent phase feedback, the present invention can equalize the phase in an open loop system path so that the entire system behaves as a negative feedback system for all frequencies of interest. Thus, by employing the embodiment of FIG. 8, the hearing aid even in the face of acoustic feedback will not oscillate.

Figure 9:
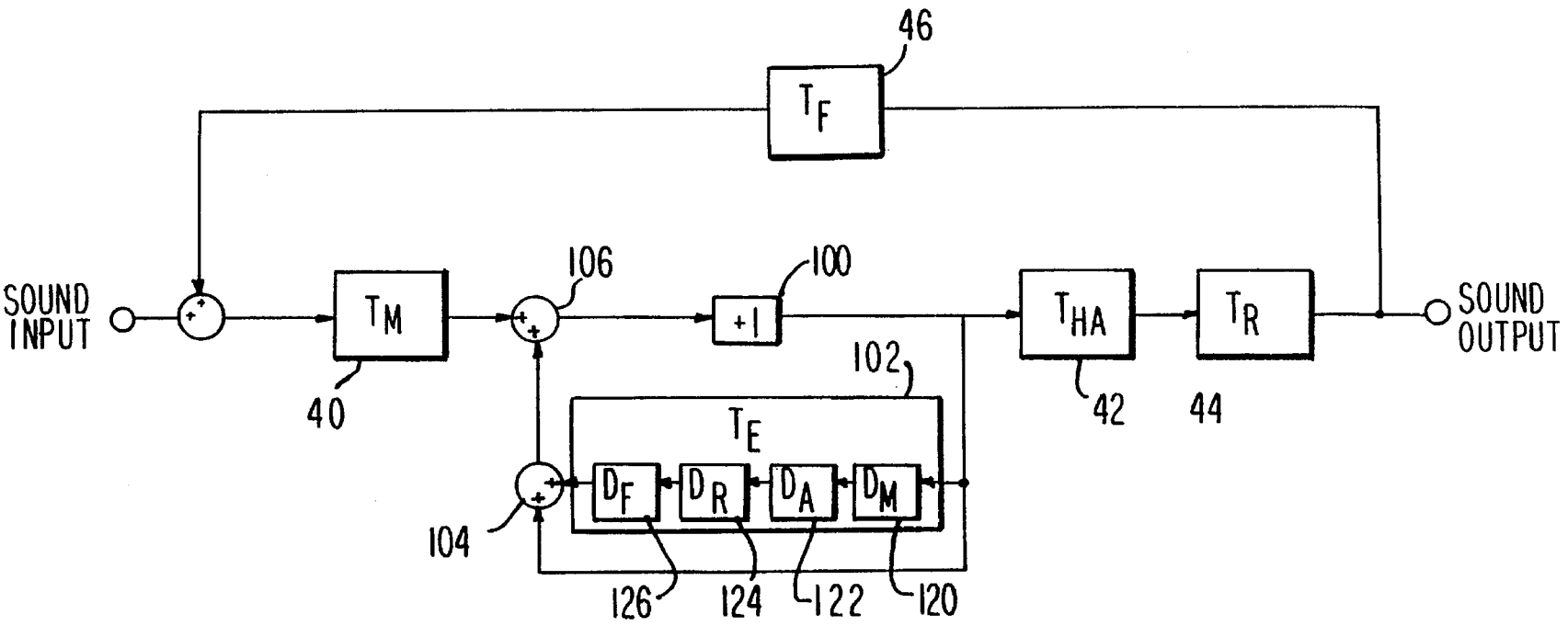
FIG. 9 is a signal flow graph of the control system of FIG. 8 shown in more detail.

The embodiment of FIG. 8 is shown in further detail in FIG. 9, in which the phase equalizer block 102 is shown to consist of a cascade of first order or second order all-pass filter sections 120, 122, 124, and 126, which correspond respectively to the phase of the microphone transfer function 40, the amplifier transfer function 42, the receiver transfer function 44, and the feedback path transfer function 46. With the body temperature of the human being generally fixed, the transfer functions of the microphone 40 and receiver 44 generally tend to be constant, so that the corresponding phase delay sections $D_M$ and $D_R$, represented at blocks 120, 124, respectively, can also be fixed as well. Even though the gain of the amplifier block 42 is variable by the wearer manipulating a control, the phase response tends to be generally uniform, so that the transfer function $D_A$ of block 122 corresponding to the amplifier can also have a fixed delay. Only the transfer function of the acoustic feedback path block 46 changes dynamically, so that only the transfer function $D_F$ of block 126 requires any adjustment. Such adjustment can be made either by substituting components or by the wearer manipulating a suitable trim pot. Nevertheless, if the phase of the transfer function $D_F$ of block 126 is set equal to the phase of the acoustic feedback path under the static conditions, the resultant system will have a 180° phase margin. Thus, even though the transfer function of the feedback path will vary, there is enough tolerance so that the system is still not likely to oscillate.

As described above, the present invention reduces adverse effects due to acoustic feedback by providing phase equalization, either directly in the signal path as in the embodiment of FIG. 4 or in a subloop, as in the embodiments of FIGS. 8 and 9. This phase equalization can be provided by one or more all-pass filters connected in cascade. Such filters should be first order or second order, as shown respectively in FIGS. 10A–10C and 11A–11B.

Figure 10A:
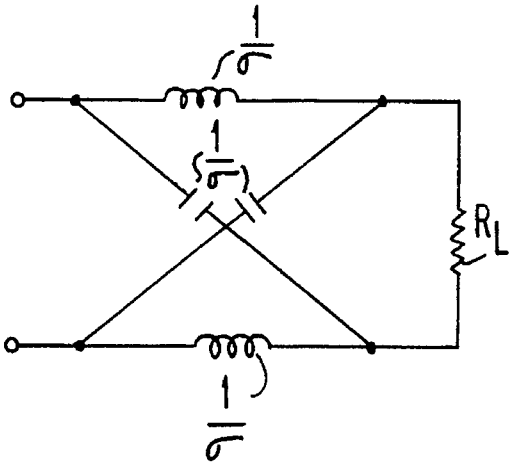
FIGS. 10A–10C are schematics of a first-order all-pass filter utilized in the above embodiments of the present invention.

FIG. 10A shows a schematic of a first-order all-pass filter realized as an LC circuit. The load is represented by a one ohm resistor $R_L$. The transfer function of the filter of FIG. 10A is represented by:

$$H(s)=(1-s/\sigma)/(1+s/\sigma) \tag{8}$$

Figure 10B:
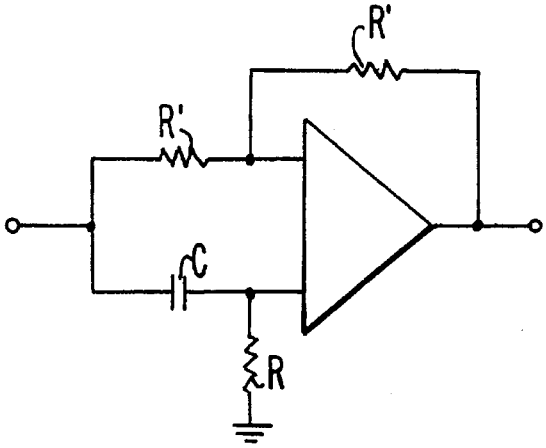
Figure 10C:
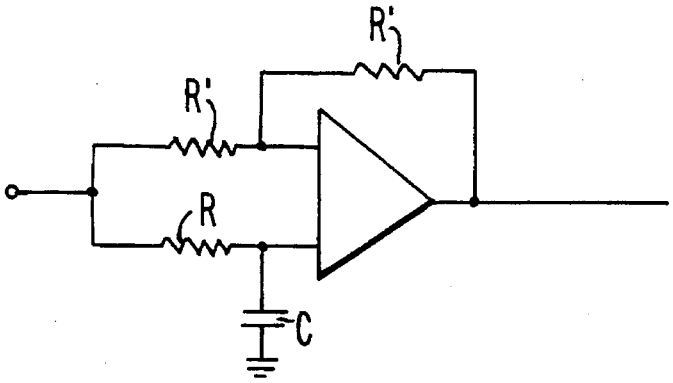

These values for the inductors and capacitors of this filter are represented in FIG. 10A. Inductors in miniature circuits, and integrated circuits particularly, are very difficult if not impossible to implement. Therefore, the filter of FIG. 10A should be embodied as an RC circuit. FIGS. 10B and 10C show such circuits, with FIG. 10B providing a lagging phase and FIG. 10C providing a leading phase. These circuit configurations are well-known and need not be explained in detail.

Figure 11A:
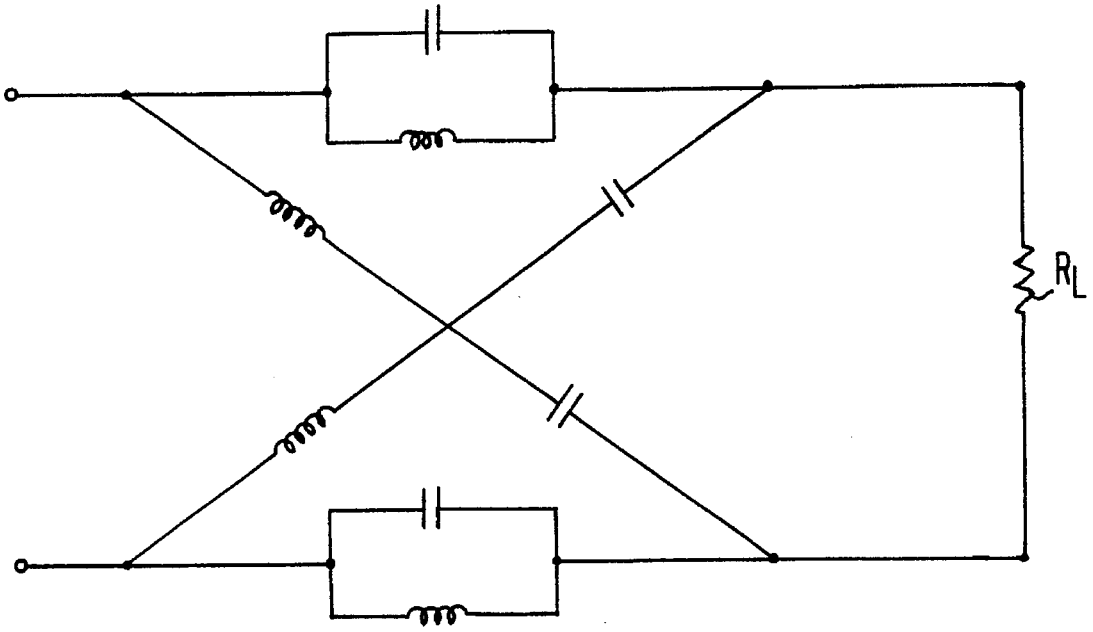
FIG. 11A and 11B are schematics of a second-order all-pass filter utilized in the above embodiment of the present invention.

Similarly, a second-order all-pass filter is shown in FIG. 11A and as LC realization. The transfer function of this filter is given by:

$$H(s)=\left[\frac{s^2-(\sigma w_i/Q_i)+w_i^2}{s^2+(\sigma w_i/Q_i)w+w_i^2}\right] \tag{9}$$

Figure 11B:
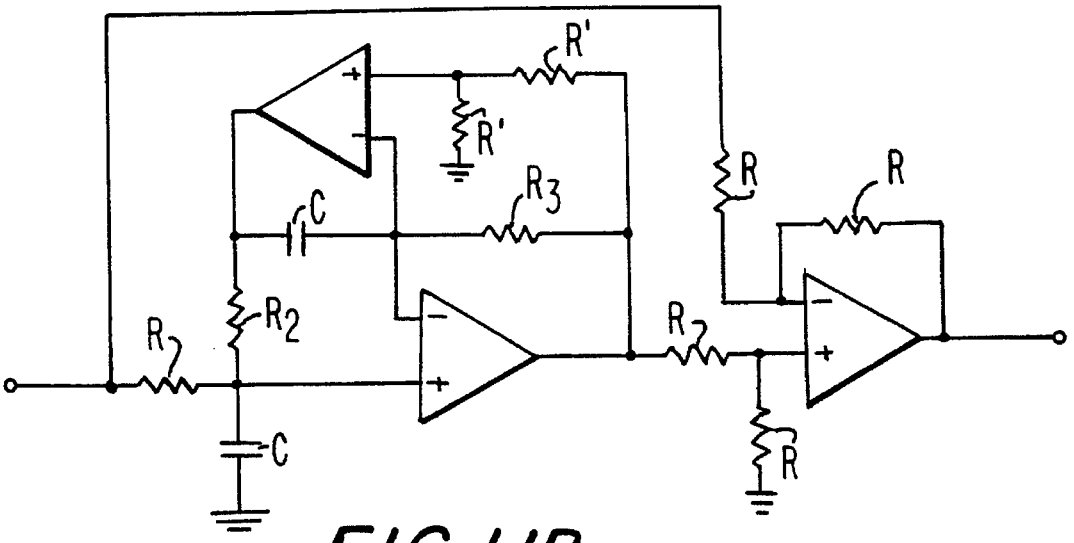

The values for the inductors and capacitors are represented in FIG. 11A, however, as noted above, the realities of semiconductor fabrication dictate an RC embodiment and such an embodiment is represented in FIG. 11B. This filter can be easily constructed as an integrated circuit. The function and operation of second-order filters is well-known, so the details thereof can be omitted. Relative component values are represent by standard nomenclature.

The above description is based on preferred embodiments of the present invention, however, it will apparent that modifications and variations thereof could be effected by one with skill in the art without departing from the spirit or scope of the invention, which is to be determined by the following claims.

What is claimed is:

1. An improved hearing aid of the in-the-ear kind that has a microphone, an amplifier supplied with an output of the microphone, and a receiver arranged collectively in a housing for placement in the ear of a wearer, in which an acoustic feedback path exists between the receiver and the microphone, the improvement comprising:

a phase equalization filter serially connected between the amplifier and the receiver for canceling a sum of minimum phase factors present in respective transfer functions of the microphone, the amplifier, the receiver, and the acoustic feedback path, respectively; and further comprising a negative feedback loop connected for feeding back an output of said phase equalization filter to one input of a signal adder that has another input connected to an output of the amplifier, an output of said signal adder being connected to an input of said phase equalization filter, wherein said negative feedback loop includes first and second filters connected in series for reducing a magnitude response of an open loop transfer function at frequencies above and below the audio frequency range.

2. An improved hearing aid of the in-the-ear kind that has a microphone, a first amplifier, and a receiver supplied with an output of the first amplifier arranged collectively in a housing for placement in the ear of a wearer, in which an acoustic feedback path exists between the receiver and the microphone, the improvement comprising:

a first signal adder having one input connected to an output of the microphone and producing an output;

a unity gain amplifier connected to said output from said first signal adder and producing an output fed to an input of the first amplifier;

a second signal adder having one input connected to receive said output from said unity gain amplifier and producing an output; and a phase equalization filter having an input connected to receive said output from said unity gain amplifier for imparting a phase compensation to said output from said unity gain amplifier that is equal to a sum of phase delays due to the microphone, the first amplifier, the receiver and the acoustic feedback path, respectively, and producing a phase-changed output fed to another input of said second signal adder, wherein said output from said second signal adder is fed to a second input of said first signal adder to form two inner feedback loops to further equalize the sum of the phase delays of the microphone, the first amplifier, the receiver and the acoustic feedback path, respectively.

3. The improved hearing aid according to claim 2, wherein said phase equalization filter comprises a plurality of filters connected in series, respective ones of said filters providing a phase compensation equal respectively to the phase delays of the microphone, the first amplifier, the receiver, and the acoustic feedback path.

4. The improved hearing aid according to claim 3, wherein each of said plurality of filters is selected from one of a first-order filter and a second-order filter.

* * * * *